United States Patent [19]

Kerboul et al.

[11] Patent Number: 4,726,785

[45] Date of Patent: Feb. 23, 1988

[54] CONNECTOR FOR COUPLING DIFFERENT TYPES OF ELECTRIC CABLES

[75] Inventors: Michel Kerboul; Michel Mounier; Paul Nuss, all of Lannion; Jean-François Schick, Paris, all of France

[73] Assignee: Goro, S.A., Chellas, France

[21] Appl. No.: 884,235

[22] Filed: Jul. 10, 1986

[30] Foreign Application Priority Data

Jul. 17, 1985 [FR] France ..... 85 10940

[51] Int. Cl.[4] ..... H01R 4/24

[52] U.S. Cl. ..... 439/417; 439/418

[58] Field of Search ..... 339/97 R, 98, 99 R, 339/103 M, 274; 439/387, 389, 391, 417, 418

[56] References Cited

U.S. PATENT DOCUMENTS

| | | | |
|---|---|---|---|
| 2,534,881 | 12/1950 | Schroeder | 339/97 R X |
| 3,041,575 | 6/1962 | Schneider | 339/99 R |
| 3,951,505 | 4/1976 | Williams | 339/103 M |
| 4,318,580 | 3/1982 | Fleisher et al. | 339/274 X |
| 4,451,867 | 5/1984 | Robertson | 339/98 X |
| 4,473,715 | 9/1984 | Beinhaur et al. | 339/67 X |

FOREIGN PATENT DOCUMENTS 2482790 6/1983 France .

*Primary Examiner*—John McQuade

*Attorney, Agent, or Firm*—Pollock, VandeSande & Priddy

[57] ABSTRACT

In a general-purpose connector for flat electric cables and pairs of separate conductors, an insulating connector body has two ducts for receiving the cables to be connected and two connecting-strips which are capable of displacement opposite to both edge walls of the ducts. An end-cap engaged on the connector body serves to press the two connecting-strips into the insulating sheath of the two cables in order to effect the desired connections. Two detachable supporting-bars of insulating material are placed within the ducts and are provided with edge channels. The connector can be employed for connecting two pairs of separate conductors placed within the edge channels or for connecting two flat cables engaged directly within the ducts after withdrawal of the supporting-bars.

7 Claims, 15 Drawing Figures

CONNECTOR FOR COUPLING DIFFERENT TYPES OF ELECTRIC CABLES

BACKGROUND OF THE INVENTION

1. Field of the Invention

This invention relates to the connectors employed for establishing a connection between the conductors of two cables to be joined together.

2. Description of the Prior Art

In order to facilitate cable-connecting operations of this type and especially in order to avoid the need to bare the ends of cable conductors, it has already been proposed to provide connectors with movable connecting-strips which can be pressed into the insulating sheath of the cables to be connected in order to come into contact with the conductors which are enclosed in the sheath.

Thus French patent No. 2,482,790 has for its object a connector in which an insulating connector body has two ducts for receiving the cables to be joined together and which is fitted with two movable metallic connecting-strips located opposite to both edges of said ducts. This connector is intended to receive two flat cables each containing two conductors placed near each edge. Thus, when the cable ends are placed within the ducts of the connector body, each movable connecting-strip is located opposite to one of the conductors of each cable.

The connector of the prior art is provided with an end-cap which is designed so as to exert a pressure on the movable connecting-strips when it is being placed in position. Each connecting-strip is consequently pressed into the insulating sheath of each cable in order to come into direct contact with the corresponding conductor. To this end, the end-cap has an internal wall of conical shape and is fixed on the connector body by screwing, thus making it possible to exert a high pressure on the movable connecting-strips.

However, this connector is suitable only for a predetermined type of electric cable since the cross-sectional area of the ducts of the insulating body must correspond to that of the cables to be connected. Thus, if the connector is designed to receive flat cables having two conductors placed on each side of an axial metallic core, it cannot be employed for connecting cables of smaller width in which no provision is made for an axial core. A fortiori, this connector cannot be employed for connecting independent conductors. In many practical applications, however, it is necessary to connect separate conductors which form part of a multiconductor assembly.

For the reason just given, the object of the present invention is to provide a general-purpose connector which can be employed for coupling different types of cables or conductors. However, another object of the invention is to provide a certain number of improvements in a connector of this type.

SUMMARY OF THE INVENTION

The invention is accordingly directed to a connector of the type recalled in the foregoing, in which the insulating body has two ducts for receiving cables to be connected and two metallic connecting-strips mounted so as to be capable of moving opposite to both edge walls of said ducts as well as an end-cap which is intended to be fitted separately on the connector body in order to press said two connecting-strips into the insulating sheath of the two cables and thus to effect the desired connections. However, the distinctive feature of the connector lies in the fact that provision is additionally made for two detachable supporting-bars of insulating material which have a cross-section similar to that of flat electric cables and the edge faces of which are provided with two channels for receiving separate electric conductors, said supporting-bars being intended to be placed inside ducts provided within the insulating body of said connector. The result thereby achieved is that said connector can be employed with equal ease either for connecting two pairs of independent conductors placed beforehand within the channels of said detachable supporting-bars or else for connecting two flat cables which are engaged directly within the ducts of the connector body after withdrawal of the detachable supporting-bars.

Thus the connector under consideration can be employed with equal ease either for connecting flat cables containing two conductors or for connecting two pairs of separate conductors.

In an advantageous embodiment, said connector is also designed to permit connection of flat cables of two standard types but of different widths, that is to say cables which are provided with an axial metallic core and cables which are not provided with a core of this type.

In this form of construction, the ducts of the insulating body have a width which makes it possible to position flat cables having an axial metallic core in addition to the two conductors placed on each side. The distinctive feature of the connector lies in the fact that the bottom end portion of each duct is provided with an extension having a smaller width corresponding to that of flat cables which do not have an axial core. In accordance with another distinctive feature, two other movable connecting-strips are displaceably mounted in oppositely-facing relation to both edge walls of the bottom end extensions of said ducts, the arrangement being such that an inward thrust is also exerted on said connecting-strips by the connector end-cap when this latter is being placed in position. Said connecting-strips are thus capable of establishing a connection between conductors of cables which have a small width while the other connecting-strips are capable of establishing a connection between conductors of cables of a type having a maximum width.

Preferably, the two movable connecting-strips on the same side are constituted by the lateral arms of a generally U-shaped metallic component, the central arm of the U being located externally of the connector body in order to be thrust inwards by the end-cap when this latter is being placed in position.

In accordance with a further distinctive feature of the present connector, the insulating body of the connector is formed by assembling one against the other two portions provided with complementary grooves which are capable of forming the two ducts provided in said connector body. The two portions aforesaid are attached to each other by means of a flexible strap-hinge and are provided with complementary position-setting surface elevations and depressions such as nipples and corresponding cavities, for example. The advantage afforded by a structure of this type lies in the possibility of molding the connector body in a mold of simple design. In addition, this structural arrangement facilitates subsequent assembly of the various components provided within said connector body.

BRIEF DESCRIPTION OF THE DRAWINGS

These and other features of the invention will be more apparent to those skilled in the art upon consideration of the following description and accompanying drawings, wherein.

DETAILED DESCRIPTION OF THE INVENTION

Figure 3:
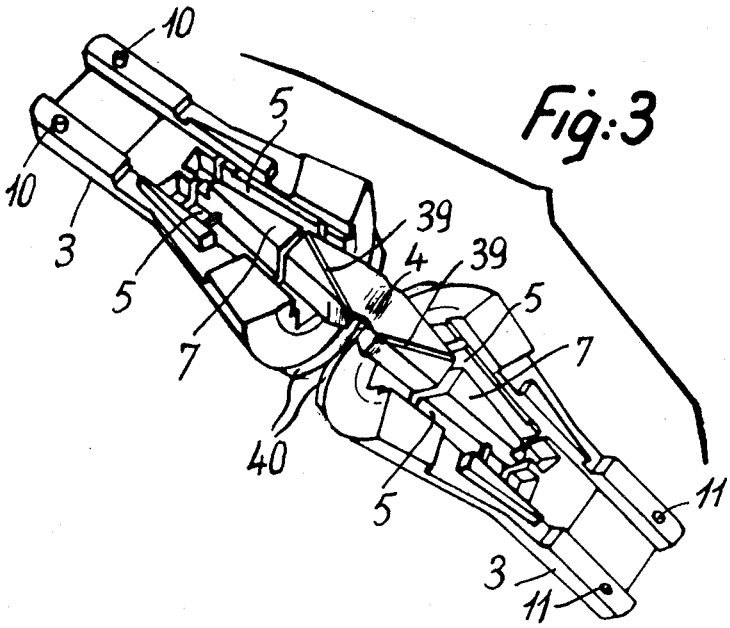
FIG. 3 is a view in perspective showing the two complementary portions of the connector body prior to folding back against each other.

The connector in accordance with the present invention has two principal components, namely a body 1 and an end-cap 2, these components being both formed of insulating material and in particular of molded plastic material. However, the connector body 1 is formed by two identical portions 3 which are assembled against each other and attached together by means of a flexible strap-hinge 4 (as shown in FIG. 3). On the faces which are intended to be applied against each other, said two portions of the connector body are provided with grooves 5 which are capable of closing together so as to form within the connector body 1 two slightly divergent ducts 6 separated by a central connector core 7 having a triangular or trapezoidal contour.

Figure 11:
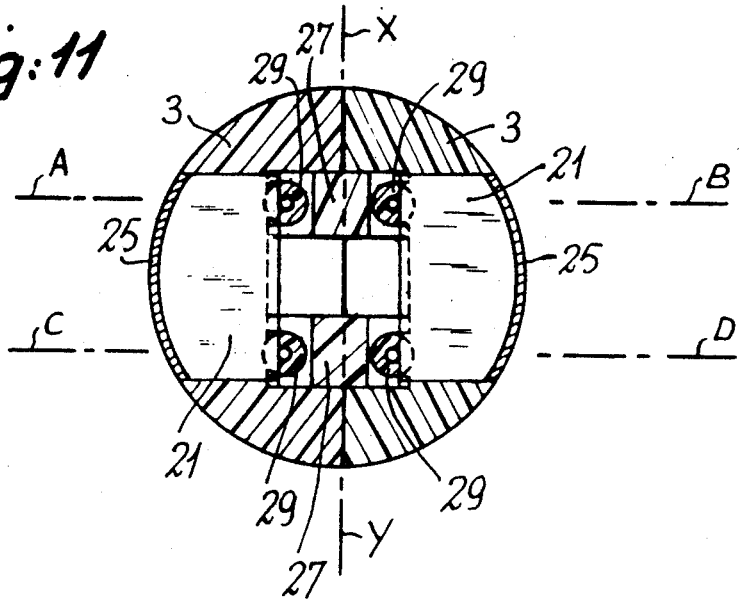
FIG. 11 is a transverse sectional view taken along line XI—XI of FIG. 10, the end-cap having been omitted from the figure.
Figure 14:
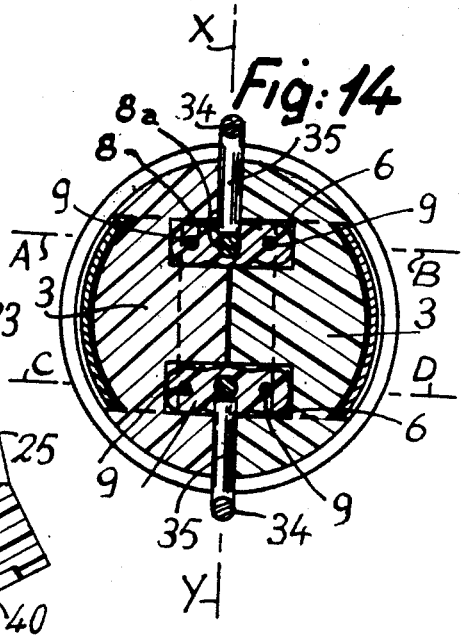
FIGS. 14 and 15 are transverse sectional views taken respectively along line XIV—XIV of FIG. 12 and along line XV—XV of FIG. 13, the end-cap having been omitted from these figures.

The aforesaid ducts each have a rectangular cross-section corresponding to the cross-sectional shape of the flat electric cables 8 of relatively substantial width, these cables being of the type comprising an axial metallic core 8*a* and a conductor 9 on each side of said core. The assembly of core and conductors is embedded in the insulating sheath of the corresponding cable. In consequence, the width of these ducts is identical with that of cables of this type. In addition, the mid-planes AB and CD of these ducts are located at right angles to the plane of junction X-Y of the two complementary portions 3 of the connector body 1 (as shown in FIGS. 11 and 14).

On their internal faces, the two portions 3 of the connector body 1 are also provided with complementary surface elevations and depressions which are intended to ensure correct position-setting of said connector body portions when these latter are applied against each other. These surface elevations and depressions can consist of two nipples 10 formed on one of said two portions and two corresponding cavities 11 formed in the other portion.

Figure 1:
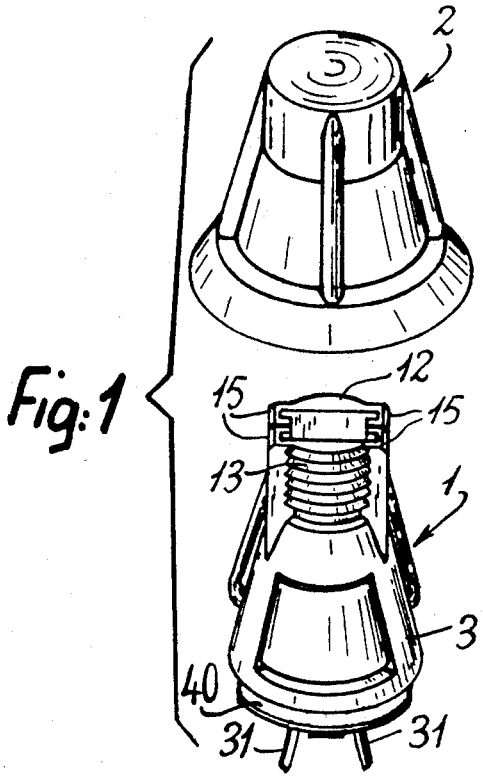
FIG. 1 is a view in perspective showing the connector body and its end-cap prior to assembly of these two components.

As is apparent from FIG. 1, the insulating body 1 formed by joining together the two complementary aforesaid portions has a frusto-conical shape. The top portion of said insulating body is adapted to carry a retaining head 12 provided with a series of superposed ribs 13 having a saw-tooth cross-section. Said ribs are intended to permit fastening of the end-cap 2 in the position of maximum downward engagement of this latter when the connecting operation is being performed on two cables, the upper portion of the internal wall of said end-cap being in turn provided with a series of complementary fastening ribs 14.

The ribs 13 formed on the two complementary portions 3 of the connector body are separated by projecting portions 15 which are so designed as to constitute guides or slide rails for guiding the end-cap 2 at the time of downward engagement of this latter. To this end, said end-cap is provided with parallel grooves 16 having the same cross-section. When the connector is in the standby state prior to use, the end-cap 2 is located in the raised position shown in FIG. 1, only the first rib 14 of this latter being engaged on the first rib 13 of the connector body 1.

It is worthy of note that the internal wall of said end-cap has a frusto-conical shape and that the same applies to the external wall of the connector body 1.

The bottom end portions of the two ducts 6 formed in said connector body are each provided with an extension 17 having a smaller width in order to correspond to the small width of flat electric cables 18 which have only two conductors 19 without any axial core in contrast to the cables 8 mentioned earlier. The extensions thus provided are therefore separated from the main portions of the ducts 6 by shouldered portions 20 which are capable of serving as abutments or stops for flat cables 8 of substantial width at the time of engagement of these latter within said ducts.

Provision is made opposite to the edge walls of the two ducts 6 for two metallic connecting-strips 21. These strips are located in the same plane at right angles to the axis of the connector body 1 and are slidably mounted within slots 22 of said connector body. Similarly, provision is made opposite to said extensions 17 of the ducts 6 for two other similar connecting-strips 23 which are slidably mounted within slots 24 of the connector body 1.

Figure 5:
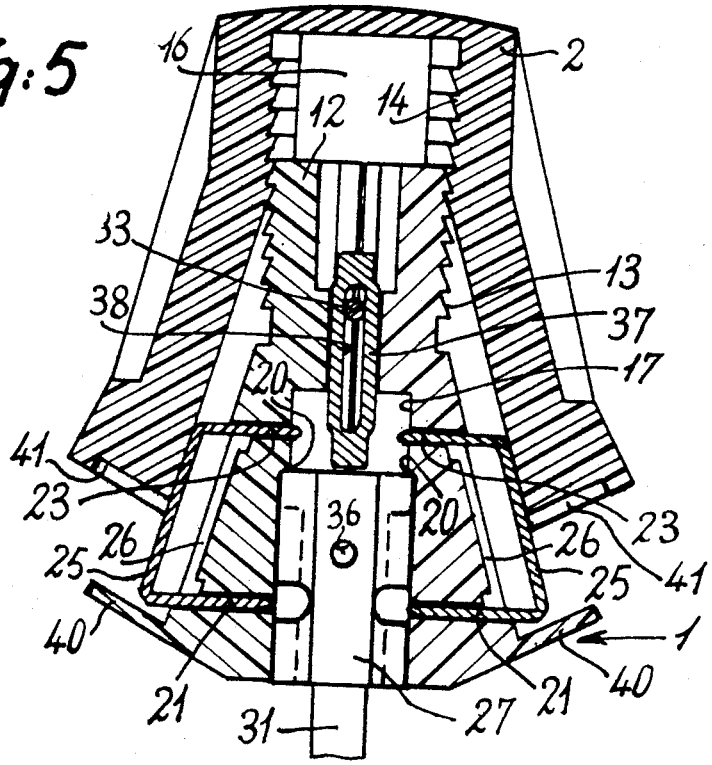
Figure 6:
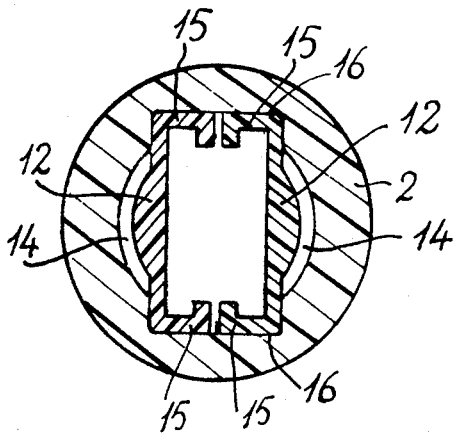
FIG. 6 is a transverse sectional view taken along line VI—VI of FIG. 4.

The two connecting-strips 21 and 23 which are located on the same side of the connector are constituted by the lateral arms of a generally U-shaped metallic component member 25, the central arm of the U being inclined at an angle which is similar to the angle of slope of the external wall of the connector body 1. In the standby position, the central arm of each of these two connecting members projects outwards from said external wall as shown in FIG. 5. However, the arrangement is such that the central arm of each connecting aforesaid member is subjected to an inward thrust exerted by the internal wall of the end-cap 2 as this latter is being downwardly engaged. The external wall of the connector body 1 is accordingly provided with two small depressions 26 which are capable of receiving the central arms of these two connecting members when they are fully driven back by the end-cap 2.

Figure 7:
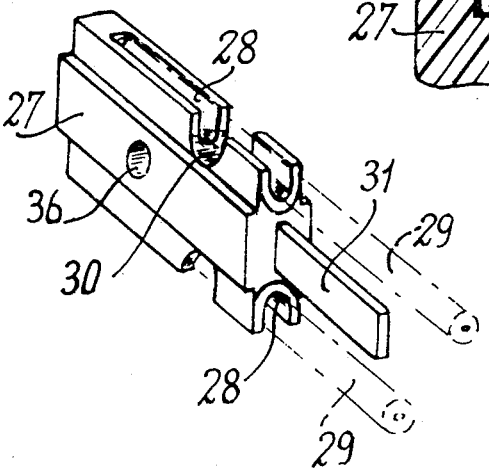
FIG. 7 is a view in perspective to a different scale and showing one of the detachable supporting-bars provided in the connector body, said supporting-bar being intended to receive two separate conductors.
Figure 8:
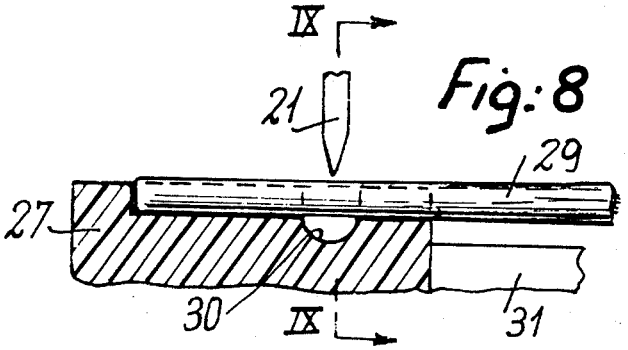
FIG. 8 is a fragmentary axial sectional view of said supporting-bar and illustrates a connecting-strip as it comes into contact with one of the conductors carried by this latter.
Figure 9:
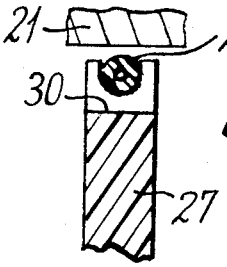
FIG. 9 is a fragmentary sectional view taken along line IX—IX of FIG. 8.

An important feature of the connector in accordance with the invention lies in the fact that the connector body 1 contains two detachable supporting-bars 27 which are placed within the ducts 6. It should further be noted that, as in the case of the single supporting-bar which is drawn to a larger scale in FIG. 7, the supporting-bars are identical in width to said ducts since their cross-section is similar to that of the flat cables 8 of relatively substantial width which have an axial core 8*a*. In consequence, said supporting-bars are stopped by the shouldered portions 20 provided within the ducts 6 (as shown in FIG. 5).

Each supporting-bar is provided on both edge faces with a longitudinal channel 28 for receiving a separate conductor 29 which may form part of a multiconductor assembly. Thus, each supporting-bar 27 is capable of receiving the two conductors of the same pair which are to be connected to the two conductors of the corresponding pair provided in the following conductor assembly.

Each supporting-bar 27 is provided with a transverse groove 30 opposite to the corresponding connecting-strip 21 which is located nearest the entrance of the respective duct 6, said transverse groove 30 being of greater depth than the longitudinal channel 28. As will be explained hereinafter, the transverse groove aforesaid makes it possible to guard against any danger of cutting of the corresponding conductor 29.

Figure 2:
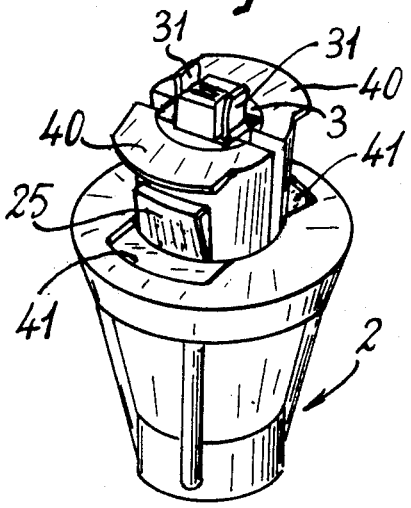
FIG. 2 is a view in perspective looking from a different angle and showing said two components after assembly.

Moreover, each supporting-bar 27 is adapted to carry a gripping lug 31 which projects outwards from the connector body as clearly shown in FIGS. 1 and 2. These lugs are intended to permit ready withdrawal of the detachable supporting-bars 27 when these latter are not in use.

Figure 4:
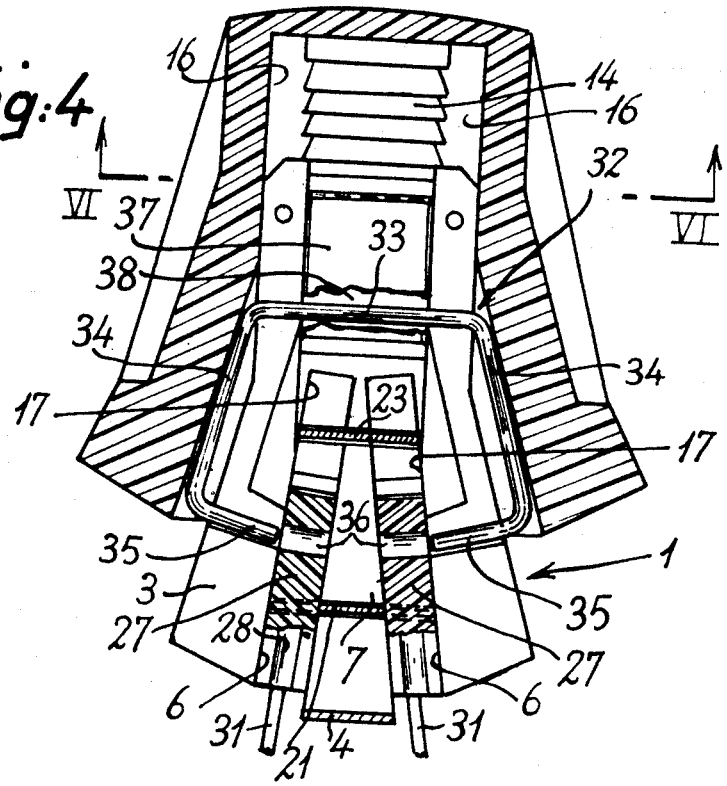
FIGS. 4 and 5 are axial sectional views of said connector, these views being taken in two section planes which are located at right angles to each other and the first of which corresponds to the plane of junction of the two complementary portions of the connector body, the connector being shown in the standby position prior to use.

The connector body is also provided with a connecting-yoke 32 of wire for establishing an electrical connection between the axial cores 8*a* of two large-width cables 8 when the connector is employed for coupling cables of this type. Said wire yoke is located in the plane of junction of the two complementary portions 3 of the connector body 1 and has the general shape of a U. The central arm 33 of the U is placed transversely at a short distance from the bottom end of the ducts 6 while the lateral arms 34 of the U are located outside the connector body 1 as illustrated in FIG. 4. The two lateral arms of the yoke are inclined at an angle which is similar to the angle of slope of the external wall of the connector body 1 and are intended to be thrust back in the inward direction at the time of engagement of the end-cap 2. The end portions 35 of said two lateral arms are elbowed in the inward direction towards the ducts 6 and are consequently adapted to engage within said ducts at the time of downward displacement of the end-cap 2, this being achieved by virtue of the elasticity of the aforesaid yoke 32.

It is worthy of note in this connection that the detachable supporting-bars 27 are each provided with a hole 36 located opposite to the end portions 35 of said yoke. Said holes are therefore capable of receiving and locking said end portions at the time of downward engagement of the end-cap 2 if the supporting-bars 27 are in position.

Between the two connecting-strips 23 which are located in the bottom end-portion of the ducts 6 or more precisely at the location of the duct extensions 17, provision is made for an isolating screen 37 of flat shape which is placed substantially in the plane of junction X-Y of the two complementary portions of the connector body 1. Furthermore, said isolating screen is capable of displacement in sliding motion along said plane of junction. To this end, said screen has an oblong slot 38 within which is placed the central arm 33 of the connecting-yoke 32.

When the connector is in the standby position prior to use, the isolating screen 37 is located in the position shown in FIG. 5 in which it is partially engaged within the extensions 17 of the two ducts 6. In consequence, part of said screen is located between the two connecting-strips 23 in order to guard against any danger of arcing between these two connecting-strips.

Preferably, the edges of the connecting-strips 21 and 23 are capable of undergoing deformation in order to conform to the profile of the metallic conductors to be connected and thus in order to obtain optimum contact. Furthermore, these connecting-strips can be provided with special metal cladding which has the effect of welding the strips to the corresponding conductors as soon as overheating occurs.

In addition, grooves 39 are formed in the central core 7 of the connector body 1 and are intended to have a gas-removing function in the event of a lightning surge effect with a view to guarding against any potential danger of bursting of the connector.

It should finally be mentioned that annular flanges 40 are formed at the base of the two complementary portions 3 of the connector body 1 and that corresponding recesses 41 are formed in the base of the end-cap 2. The function of said annular flanges is to retain the sealing lubricant or grease which is added around the connector body 1. Furthermore, the fact that said annular flanges are fitted in corresponding recesses prevents the formation of leakage paths from the connecting-strips 21 which are nearest the entrance of the ducts 6.

The different modes of utilization of the connector in accordance with the invention are as follows:

(1) Connection of two pairs of independent conductors (see FIGS. 10 and 11):

In this case, the two detachable supporting-bars 27 are used as supports for the ends of the corresponding conductors which are engaged within the longitudinal channels 28 provided in the edge faces of said supporting-bars.

Figure 10:
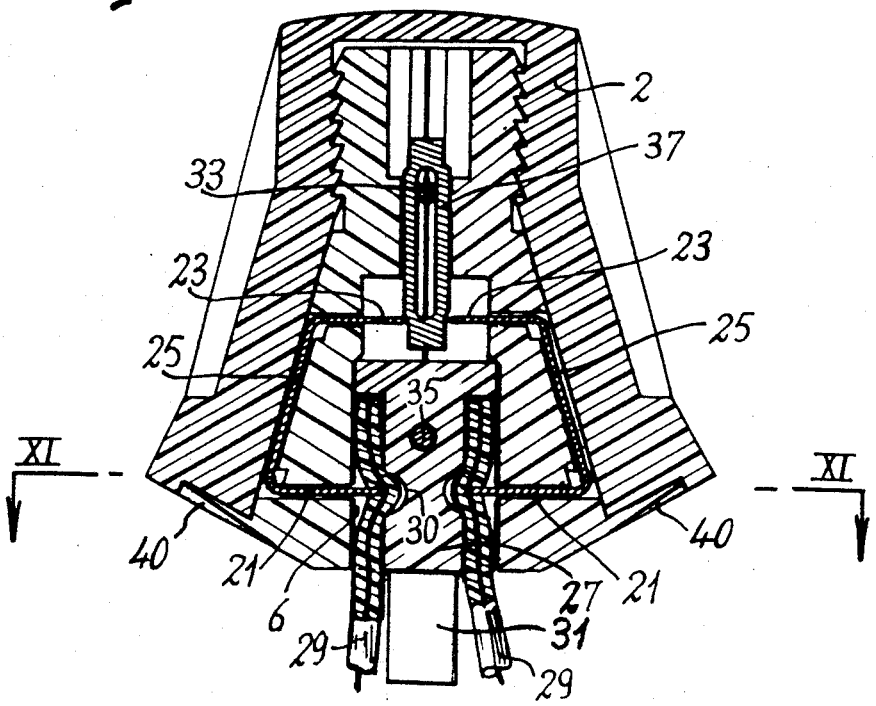
FIG. 10 is a sectional view of the connector in accordance with the invention, this view being taken along the same section plane as that of FIG. 5 but showing said connector when it is employed for coupling two pairs of separate conductors.

It is then only necessary to push the end-cap 2 fully home in order to obtain the desired connection. In fact, at the time of a downward displacement, the end-cap has the effect of thrusting-back the two connecting component members 25 as shown in FIG. 10. In consequence, the lower connecting-strips 21 are caused to penetrate into the ducts 6 and then to engage within the insulating sheath of the conductors 29, with the result that the edges of said strips come directly into contact with the corresponding conductor wires.

Thus the edge of each connecting-strip 21 is applied in contact with the wire of one of the conductors 29 which are carried by a supporting-bar 27 and with the wire of one of the conductors which are carried by the other supporting-bar 27 on the same side of the connector. The same applies to the other connecting-strip 21, with the result that the desired connections are effectively established.

In view of the fact that the supporting-bars 27 are provided at this location with a transverse groove 30 of greater depth than the longitudinal channels 28, each conductor is capable of undergoing deformation as shown in FIG. 10, thus guarding against any risk of cutting by the connecting-strips 21.

Furthermore, the slight permissible deformation of the connecting-strips at the edges of these latter accordingly produces a virtual scraping or peeling action on the insulating sheath of the conductor. Thus the action of the connecting-strips is not limited solely to a penetration of the strip into the material of the insulating sheath in a direction at right angles to the axis of the conductor since this would be liable to damage this latter.

As already mentioned, another effect produced by the downward displacement of the end-cap 2 is to cause the end portions 35 of the connecting-yoke 32 to penetrate into the holes of the supporting-bars 27, thus locking them in position. However, it is also worthy of note that, in the mode of utilization under consideration, the isolating screen 37 has remained in its initial position. In consequence, part of this screen is interposed between the two connecting-strips 23, thus forestalling any danger of arcing between the strips.

Figure 12:
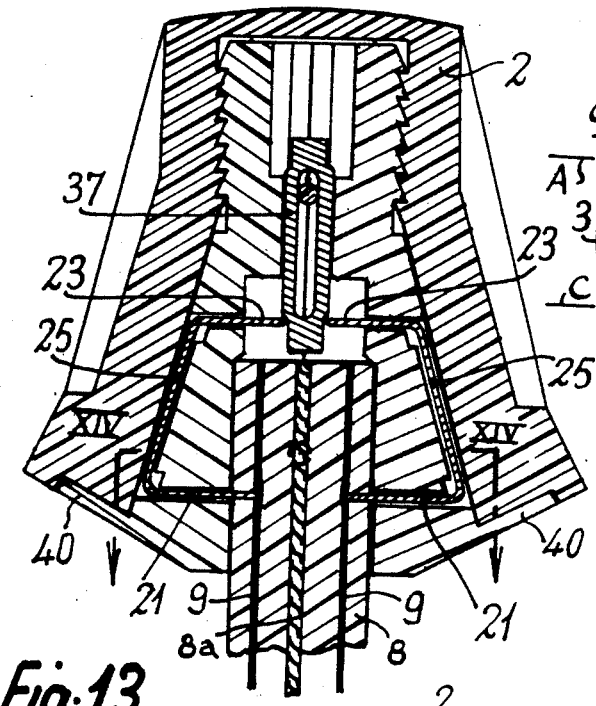
FIGS. 12 and 13 are axial sectional views taken along the same plane as in FIG. 10 but illustrating the use of the connector for coupling respectively flat cables of substantial width having an axial metallic core and flat cables which are not provided with a core of this type.

(2) Connection of two large-width cables each having an axial core (see FIGS. 12 and 14):

It is necessary in this case to proceed to complete removal of both detachable supporting-bars 27. In this operation, each supporting-bar is withdrawn from the connector body 1 by exerting a pull on its lug 31. The end portions of the two cables 8 to be connected can then be engaged within the ducts 6 until they come into abutting contact with the annular shoulder portions 20.

As in the previous mode of utilization, it is only necessary to push the end-cap 2 fully home in order to obtain the desired connections. The result achieved in this case is that the end-cap applies a backward thrust on the two connecting component members 25 and that the two strips 21 are caused to penetrate into the insulating sheath of the cables 8. The edges of the connecting-strips are thus permitted to come into direct contact with the conductors 9 provided in the corresponding edge portions of said cables. An electrical connection is thus obtained between the conductors 9 of the two cables 8 which are located on the same side. As in the previous instance, the insulating sheath is accordingly "scraped" by the edge of each connecting-strip, thus preventing any possibility of cutting of the conductors 9.

However, downward displacement of the end-cap 2 also causes penetration of the elbowed end portions 35 of the connecting-yoke 32 within the ducts 6. The pointed tips of said end portions are thus caused to penetrate into the insulating sheath of the two cables 8 and consequently come into direct contact with the axial core 8*a* of each cable. This ensures an electrical connection between the cores of these two cables and achieves enhanced mechanical strength of the complete assembly.

As in the previous mode of connection, the isolating screen 37 has remained in its initial position. Under these conditions, the screen ensures the requisite isolation between the two connecting-strips 23 while avoiding any danger of arcing between these latter.

Figure 13:
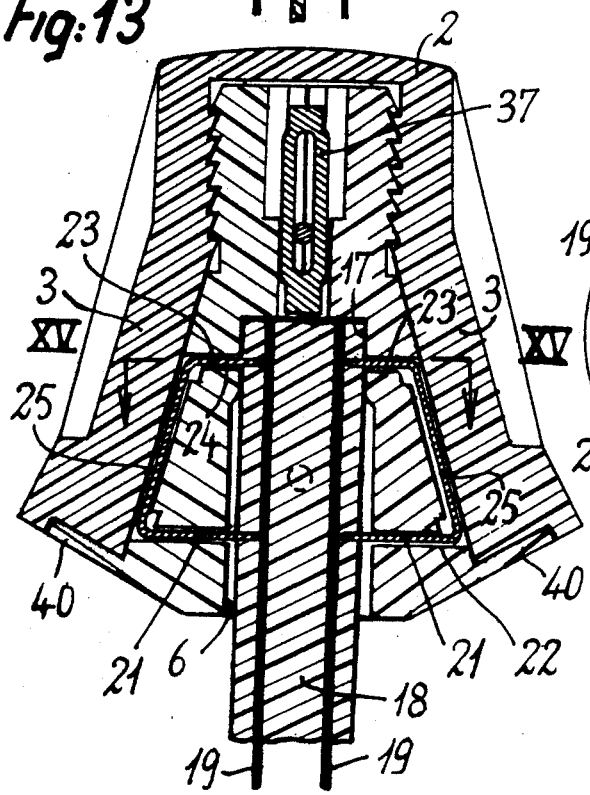

(3) Connection of two cables not provided with an axial core (see FIGS. 13 and 15):

In this mode of connection, it is again necessary to remove the detachable supporting-bars 27 in order that the end portions of the two cables 18 to be connected may be engaged within the ducts 6. However, in contrast to the preceding mode of connection, the end portions of these cables are no longer stopped by the annular shoulder portions 20 provided within said ducts. In fact, since they are smaller in width than the cables 8, the end portions of the cables 18 are engaged up to the bottom of the extensions 17 of the ducts 6 as shown in FIG. 13. During this movement, the end portions of these cables thrust the movable screen 37 back to the position illustrated in this figure.

Figure 15:
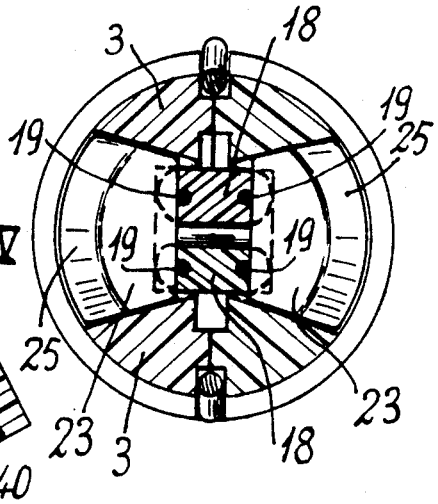

The only remaining operation then consists in fully engaging the end-cap 2 on the connector body 1 in order to obtain the desired connections. At the time of downward engagement, said end-cap thrusts back the two connecting component members 25, with the result that the connecting-strips 23 located in the bottom end of the ducts 6 or more precisely at the level of the duct extensions 17 are caused to penetrate into the insulating sheath of the cables 18 which are located in oppositely-facing relation. Thus the edges of these two connecting-strips 23 come into direct contact with the conductor wires 19 provided within the cables 18 (as shown in FIG. 15). The connections thus obtained are similar to those formed in the previous case.

A point which deserves mention here is that the connections thus established are perfect since the end portions of the cables 18 are completely locked in position within the extensions 17 of the ducts 6. This would not have been the case, however, if it had been decided to use a connector provided only with ducts corresponding to the width of cables of larger size having an axial core such as the cables 8 mentioned earlier. Another noteworthy consideration is the fact that the different modes of utilization of the connector in accordance with the invention make it possible in all cases to achieve excellent conditions of application of the edges of the connecting-strips against the corresponding conductors. This result is due to the general arrangement of the present connector and to the angle of slope of the external wall of the connector body and of the central arm of each connecting component member 25. However, the aforementioned result is also due to a virtual adaptation of the different components owing to the fact that the connector body is constituted by two complementary portions 3 which are capable of slight relative displacement and consequently of mutual adaptation.

The basic design concept of the connector in accordance with the invention is such that a cable of a predetermined type can be coupled with a cable of another type or else with independent conductors placed on one of the detachable supporting-bars 27. In fact, these various combinations are wholly feasible in practice.

As has already been mentioned, the construction of the connector body in the form of two complementary portions 3 which are intended to be joined together by applying them against each other makes it possible to mold said connector body in a mold of very simple design. However, this also facilitates subsequent assembly of the various parts provided. In fact, the isolating screen 37 as well as the transverse connecting-yoke 32 can be placed in position between these two complementary portions before they are folded-back against each other. As and when these two complementary portions of the connector are coupled together, the nipples 10 and the cavities 11 ensure suitable positioning of these two portions with respect to each other.

However, the construction of the connector body 1 in the form of two complementary portions has a further advantage in that it permits effective binding of the cables to be connected by clamping the two complementary portions 3 against the cables under the action of the pressures exerted by said end-cap 2 when this latter is engaged by downward displacement.

However, the primary advantage of the connector in accordance with the invention clearly lies in its general-purpose character since it is equally capable of connecting two entirely different types of flat cables having different widths as well as connecting separate conductors forming part of two multiconductor assemblies which have to be coupled together in succession.

Whatever arrangement may be contemplated, perfect electrical contacts are accordingly established in each case by virtue of the fact that the separate and distinct cables or conductors to be connected together are placed within housings which correspond exactly to their dimensions and that, in addition, the pressures applied on the connecting-strips are exerted under optimum conditions.

What is claimed is:

1. A connector for connecting conductors of flat electric cables each having two conductors enclosed in an insulating sheath, comprising:

an insulating connector body having two substantially parallel ducts for receiving to be connected cables, two metallic connecting-strips movably mounted opposite to both edge walls of said ducts and an end-cap to be fitted separately on the connector body in order to press said two connecting-strips into the insulating sheath of the cables for effecting the desired connections;

wherein the ducts of the insulating connector body have a width which makes it possible to position flat cables having, in addition to the two conductors placed on each side, an axial metallic core; and wherein the bottom end portion of each duct is provided with an extension having a smaller width corresponding to that of flat cables which do not have an axial core;

two other movable connecting strips being displaceably mounted in oppositely-facing relation to both edge walls of the bottom end extensions of said ducts, the arrangement being such that an inward thrust is also exerted on said connecting-strips by the end-cap of the connector when said end-cap is being placed in position; and two detachable supporting-bars of insulating material having a cross-section similar to that of flat cables with an axial metallic core and edge faces provided with two channels for receiving separate electric conductors, said supporting-bars being placed inside the ducts provided within the insulating connector body so that said connector can be employed with equal ease either for connecting two pairs of independent conductors placed beforehand within the channels of said detachable supporting-bars or for connecting two flat cables with or without an axial core, and which are engaged directly within the ducts of said connector body.

2. A connector according to claim 1, wherein the two movable connecting-strips provided on the same side comprise the lateral arms of a U-shaped metallic component, the central arm of the U-shaped metallic component being located externally of the connector body in order to be thrust inward by the end-cap of said connector when said end-cap is being placed in position.

3. A connector according to claim 2, wherein an isolating screen is provided between the two connecting-strips placed opposite to the end extensions fo the two ducts of the connector body, said isolating screen being movably mounted in such a manner so as to be backwardly displaced as a result of the movement of penetration of small width flat cables into said end extensions of said two ducts.

4. A connector according to claim 3, wherein the connector body comprises a metallic connecting-yoke disposed in a plane at right angles to the plane of the two ducts of said connector body, the elbowed end portions of said yoke being located opposite to the position of the axial core of large width flat cables when cables of this type are placed within the ducts of said connector body, the lateral arms of said yoke being disposed externally of said connector body in order to be thrust inward by the end-cap when said end-cap is being placed in position; and wherein said isolating screen is carried by said connecting-yoke whose arm is engaged within an oblong slot of said screen so as to permit displacement of said screen in sliding motion in the corresponding axial plane.

5. A connector according to claim 1, wherein the detachable supporting-bars are each adapted to include a gripping lug which forms a projection externally of the connector body so that said supporting-bars may thus be readily withdrawn.

6. A connector according to claim 1, wherein a transverse groove is provided in the respective edge faces of the detachable supporting-bars opposite to the corresponding connecting-strips, said transverse grooves being of greater depth than the longitudinal channels of said supporting-bars.

7. A connector according to claim 1, wherein the internal connector-core located between the two ducts of the connector body is provided with grooves for removal of gases.

* * * * *